US007178364B2

(12) United States Patent
Shapiro et al.

(10) Patent No.: US 7,178,364 B2
(45) Date of Patent: Feb. 20, 2007

(54) PERSONAL ADORNMENT

(76) Inventors: Kristen M. Shapiro, 450 Hupp Cross Rd., Bloomfield Hills, MI (US) 48301; Lauren L. Messelian, 95 Worth St., #7K, New York, NY (US) 10013

( * ) Notice: Subject to any disclaimer, the term of this patent is extended or adjusted under 35 U.S.C. 154(b) by 126 days.

(21) Appl. No.: 10/897,210

(22) Filed: Jul. 22, 2004

(65) Prior Publication Data

US 2006/0016218 A1 Jan. 26, 2006

(51) Int. Cl.
*A44C 5/02* (2006.01)

(52) U.S. Cl. ..... 63/3; 63/4; 59/80

(58) Field of Classification Search ..... 63/3, 63/3.1, 3.2, 4, 9, 11, 38, 39; 59/14, 80, 82, 59/85, 90, 91, 92; 446/120; 2/311, 321
See application file for complete search history.

(56) References Cited

U.S. PATENT DOCUMENTS 1,060,229 A 4/1913 Casper et al.
2,169,265 A * 8/1939 Mantz ..... 59/91
2,775,093 A 12/1956 Kundert ..... 59/80
2,807,928 A 10/1957 Wills ..... 59/80
3,848,270 A 11/1974 Rand
4,016,605 A 4/1977 Corey
4,639,948 A 2/1987 Adell
4,710,983 A 12/1987 Markoff
4,747,527 A 5/1988 Trumpower, II
4,770,008 A * 9/1988 Yamaura ..... 63/3
D344,624 S 3/1994 Schnel et al.
5,515,550 A 5/1996 Friedman et al.
5,826,280 A 10/1998 Bradley
6,041,444 A 3/2000 McKinney
6,050,463 A 4/2000 De Bono et al.
6,422,177 B1 7/2002 Noguero

* cited by examiner

*Primary Examiner*—Jack W. Lavinder
(74) *Attorney, Agent, or Firm*—Young & Basile, P.C.

(57) ABSTRACT

A personal adornment such as a belt, necklace or bracelet is created from linkable, soft plastic elements each of which includes a decorative body of distinctive shape and a short strap extending integrally therefrom. Each strap has an aperture and each body has a male protrusion formed on the back side thereof. A loop of desired length is assembled from the desired number of links. A kit includes a number of links arranged in a clear plastic container.

9 Claims, 3 Drawing Sheets

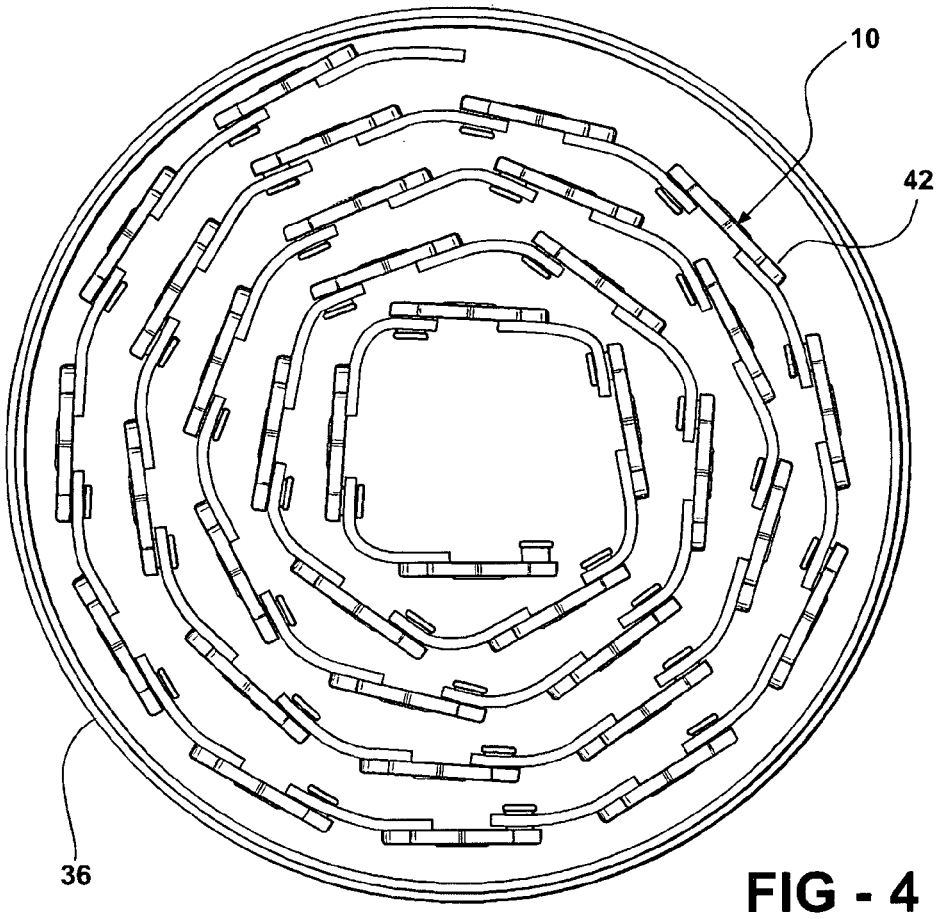
FIG - 4
FIG - 5
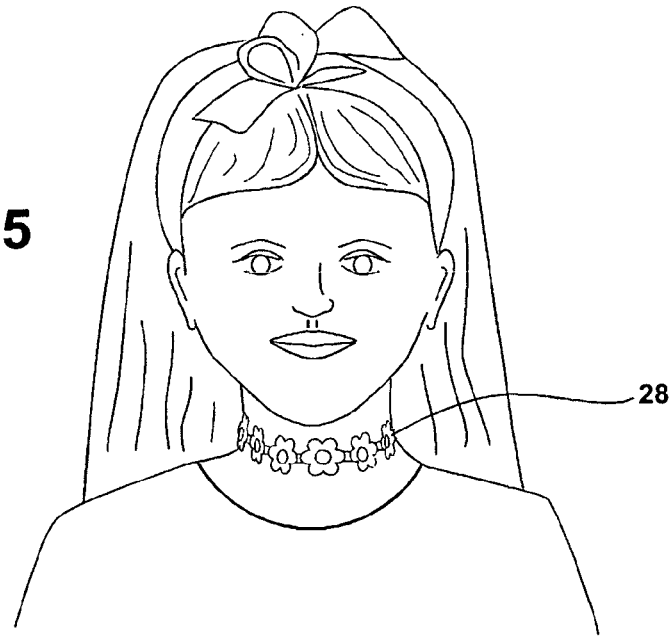

FIG - 6
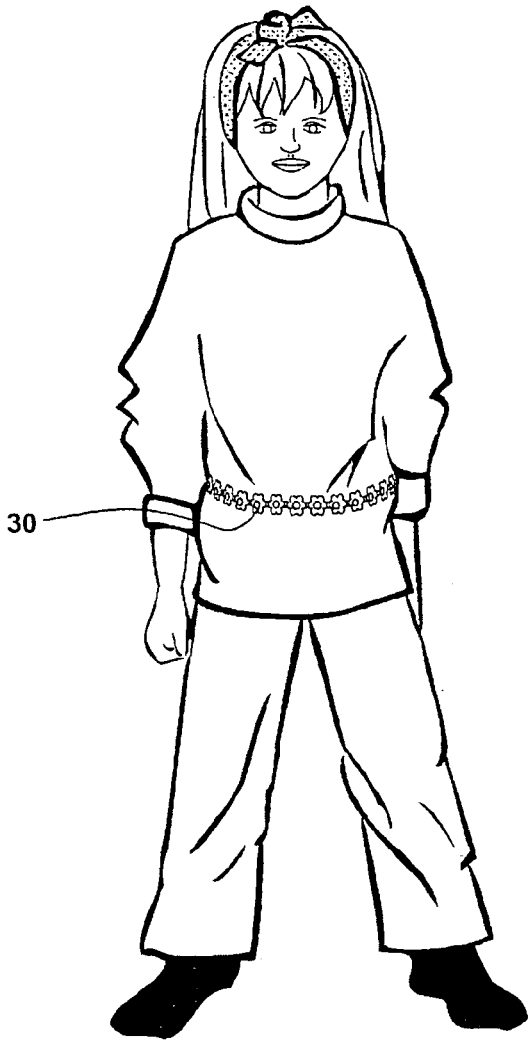
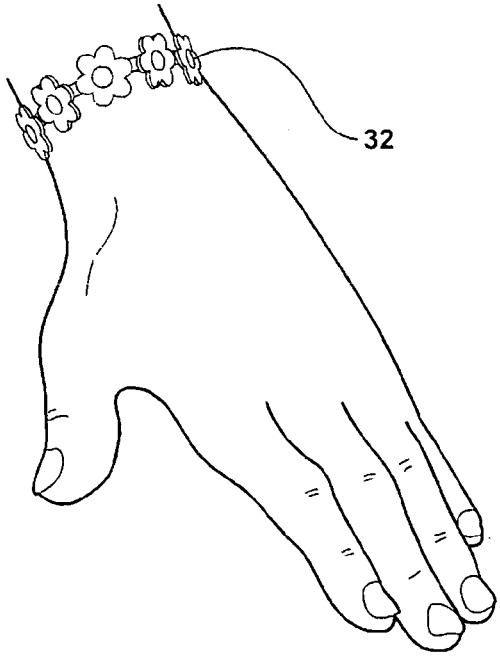
FIG - 7

PERSONAL ADORNMENT

FIELD OF THE INVENTION

This invention relates to personal adornments such as belts, necklaces and bracelets and more particularly to a personal adornment which can be assembled from a plurality of interlinkable elements.

BACKGROUND OF THE INVENTION

It is known in the art to assemble belts from a number of substantially similar or identical linking pieces which are successively interconnected by means of snap fasteners; such an article is disclosed in the 1987 patent to Robert Adell U.S. Pat. No. 4,639,948. The patent shows a hip belt assembled from large leather pieces and requires several manufacturing operations including the formation of the pieces and the addition of the individual male and female snap fasteners at spaced locations thereon. While the pieces can be used to assemble a belt, they are not suitable for the assembly of smaller adornments such as necklaces and bracelets.

SUMMARY OF THE INVENTION

In accordance with the present invention, a personal adornment such as a belt, necklace or bracelet can be assembled from a plurality of soft plastic interlinkable elements which are simple and inexpensive to manufacture and require no secondary operations to add snap fasteners or the like. In general, this is accomplished through the provision of a plurality of similar or identical interlinkable elements which are made of a pliant plastic material which can be readily injection molded to produce a finished article in one operation. In accordance with the invention, each of the elements or links comprises the integral combination of a decorative and distinctively shaped body having front and rear surfaces and, integral with the body, a short strap of the same material extending from the body and containing an aperture. The body has in protruding relationship from the rear surface a short projection of such size and shape as to fit linkingly within the aperture of the strap whereby the desired number of elements can be interlinked with one another to produce either a strap or closed loop of any desired length.

In accordance with the second objective of the invention, a kit is provided for retail sale and from which the purchaser may make a personal adornment such as a belt, or other closed-loop adornment, by selecting the desired number of interlinkable elements from the kit and assembling them in the manner described above.

In the preferred form, the kit comprises a container and a plurality of pliant plastic interlinkable elements as described above. The container is preferably cylindrical and made of a transparent material such as plastic so that the article can be seen through the material at the point of purchase and thereafter.

In accordance with the invention, the links may be manufactured in any of an infinite number of decorative shapes such as flowers or comic book characters or other interesting and desirable shapes with different themes and motifs. In addition, tinting material may be added to the plastic from which the interlinkable elements are made so as to provide a desired degree of coloring. The bodies of the links are preferably of such size as to fit easily through a standard belt loop.

Other applications of the present invention will become apparent to those skilled in the art when the following description of the best mode contemplated for practicing the invention is read in conjunction with the accompanying drawing.

BRIEF DESCRIPTION OF THE DRAWING

The description herein makes reference to the accompanying drawing where like reference numerals refer to like parts throughout the several views, and wherein:

FIG. 4 is a top view of the kit with the lid removed and showing the spiral arrangement of interlinkable elements disposed therein;

FIG. 5 is a view of a person wearing a personal adornment in the form of a necklace constructed in accordance with the invention;

FIG. 6 shows a person wearing a personal adornment in the form of a belt constructed in accordance with the invention; and FIG. 7 shows a portion of human body wearing a personal adornment in the form of a bracelet constructed in accordance with the invention.

DETAILED DESCRIPTION OF THE ILLUSTRATIVE EMBODIMENTS

Figure 1:
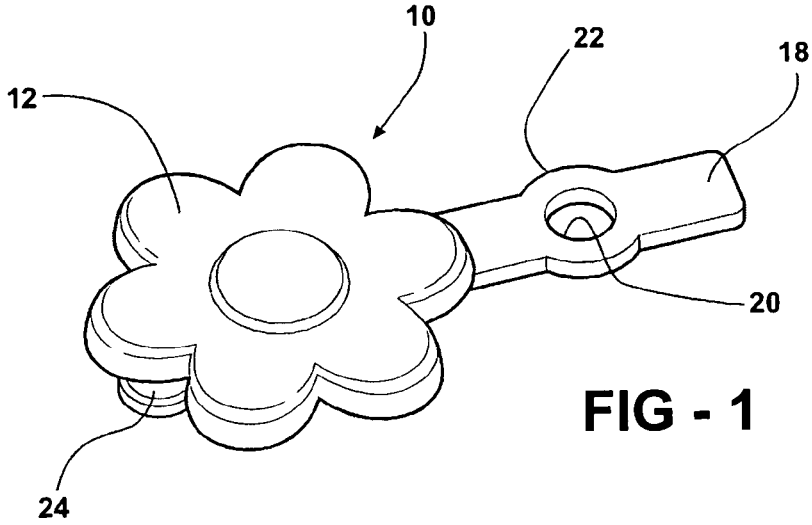
FIG. 1 is a perspective view of an interlinkable element designed and manufactured in accordance with the objectives of the invention.
Figure 2:
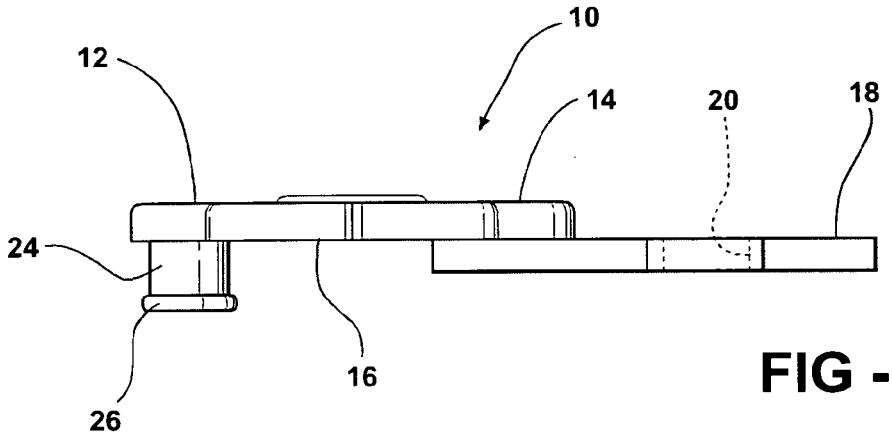
FIG. 2 is a side view of the interlinkable element of FIG. 1.

Referring to FIGS. 1 and 2, there is shown a linking element 10 comprising the integral combination of a body 12 of floral shape having a front surface 14 and a rear surface 16. Integral therewith and attached to and extending from the rear surface 16 is a short strap 18 made of the same material and containing an aperture 20 surrounded by a slightly enlarged strap portion 22. Depending integrally from the rear surface 16 at the end opposite the attachment of the strap 18 is a protrusion 24 of such size and shape as to fit snugly and linkingly within the aperture 20 of the strap 18. The protrusion preferably is molded with a slightly larger diameter collar or flange 26 at the free end thereof. The length of the protrusion 24 is such as to fit fully into and through the aperture 20 in the strap 18 such that the collar 26 lies outside of the internal confines of the aperture 20 when two of the identical interlinkable elements are linked together.

The elements 10 are preferably made of a relatively soft or pliant injection moldable plastic material such as LDPE or PVC which is relatively clear or transparent but may be colored through the addition of suitable plastic tinting materials as will be apparent to those skilled in the plastic injection molding arts. The elements 10 are on the order of 2 inches in overall length and of such width as to fit through a normal 1½ to 2 inch belt loop without undue difficulty.

As shown in FIG. 5, the desired number of interlinkable elements 10 may be assembled into a closed loop to form a necklace 28 of any desired length so as to snugly or loosely fit the neck of the wearer. As shown in FIG. 6, any desired number of interlinkable elements 10 can be assembled to form a closed loop belt 30 requiring no snaps, buckles or other expensive elements for assembly or closure. As shown in FIG. 7, any desired number of elements 10 can be used to assemble a closed loop 32 of smaller diameter which can be worn as a bracelet.

Figure 3:
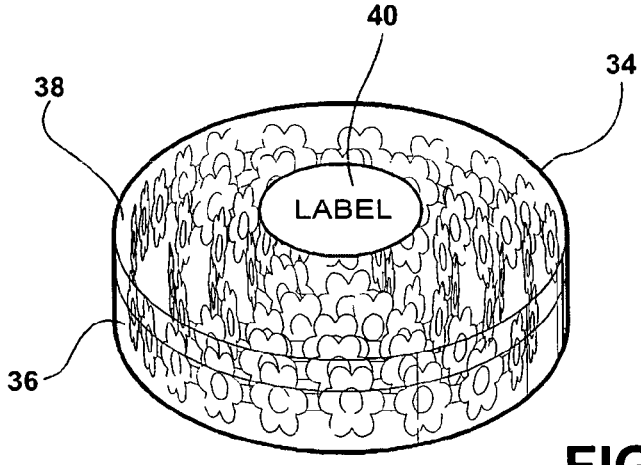
FIG. 3 is a perspective view of a kit made in accordance with the invention.

As shown in FIGS. 3 and 4, a number of the interlinkable elements 10 are preferably sold as a kit in a container 34 comprising a short cylindrical base 36 and a mating lid 38, the lid 38 being configured so as to receive a suitably printed adhesive label 40 on the top surface thereof as shown.

As shown in FIG. 4, the links 10 can be neatly arranged in a linked and spiral fashion within the container base 36. Although shown as stored within the container 36 in a linked state, the elements 10 can also be packaged unlinked by arranging them in spiral, shingled or overlapping fashion until they reach a center point where the degree of curvature prohibits the addition of any further links. The kits can be marketed in different colors for different purposes and with bodies 12 of many different shapes including not only the floral shape shown but also the shape of comic strip characters, fictional characters, television characters, automobiles, airplanes and any other recognizable moldable article.

While the invention has been described in connection with what is presently considered to be the most practical and preferred embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A personal adornment comprising:

a plurality of detachably interlinkable elements, each element including a body of pliant plastic material in an ornamental shape and having front and rear surfaces and, integral therewith, a non-coplanar strap of the same material extending from the body and containing an aperture spaced from the body said strap having a width which is substantially less than the width of the ornamental shape;

said body having in protruding relationship to said rear surface a projection of such size and shape as to fit linkingly into the strap aperture such that the ornamental shape overlies and hides the strap aperture of an adjacent element when the elements are linked;

wherein the projection extends from the rear surface of the body near an edge thereof farthest from the integral strap such that the link between adjacent interlinked elements is off center relative to the ornamental shape;

whereby the elements may be interlinked with one another in a chain or closed loop of substantially any desired length.

2. The personal adornment defined in claim 1 wherein the strap is non-coplanar with the body and extends integrally from the rear surface of the body.

3. A kit for maldng personal adornments comprising:

a container; and within said container, a plurality of detachably interlinkable elements, each element including a body of pliant plastic material in an ornamental shape and having front and rear surfaces and, integral therewith, a non-coplanar strap of the same material extending from the body and containing an aperture spaced from the body said strap having a width which is substantially less than the width of the ornamental shape;

said body having in protruding relationship to said rear surface a projection of such size and shape as to fit linkingly into the strap aperture such that the ornamental shape overlies and hides the strap aperture of an adjacent element when the elements are linked;

wherein the projection extends from the rear surface of the body near an edge thereof farthest from the integral strap such that the link between adjacent interlinked elements is off center relative to the ornamental shape;

whereby the elements may be interlinked with one another in a chain or closed loop of substantially any desired length.

4. The kit defined in claim 3 wherein the container is cylindrical.

5. The kit defined in claim 3 wherein the container is transparent.

6. A necklace comprising:

a plirality of detachably interlinked elements, each element including a body of pliant plastic material having front and rear surfaces and, integral therewith, a non-coplanar strap of the same material in an ornamental shape and extending from the body and containing an aperture spaced from the body said strap having a width which is substantially less than the width of the ornamental shape;

said body having in protruding relationship to said rear surface a projection of such size and shape as to fit linkingly into the strap aperture such that the ornamental shape overlies and hides the strap aperture of an adjacent element when the elements are linked;

wherein the projection extends from the rear surface of the body near an edge thereof farthest from the intearal strap such that the link between adjacent interlinked elements is off center relative to the ornamental shape:

whereby the elements may be interlinked with one another in a chain or closed loop of substantially any desired length.

7. A bracelet comprising:

a plurality of detachably interlinked elements, each element including a body of pliant plastic material having front and rear surfaces and, integral therewith, a non-coplanar strap of the same material in an ornamental shape and extending from the body and containing an aperture spaced from the body said strap having a width which is substantially less than the width of the ornamental shape;

said body having in protnxiing relationship to said rear surface a projection of such size and shape as to fit linkingly into the strap aperture such that the ornamental shape overlies and hides the strap aperture of an adjacent element when the elements are linked;

wherein the projection extends from the rear surface of the body near an edge thereof farthest from the intearal strap such that the link between adjacent interlinked elements is off center relative to the ornamental shape:

whereby the elements may be interlinked with one another in a chain or closed loop of substantially any desired length.

8. A belt comprising:

a plurality of detachably interlinked elements, each element including a body of pliant plastic material having front and rear surfaces and, integral therewith, a non-coplanar strap of the same material in an ornamental shape and extending from the body and containing an aperture spaced from the body said strap having a width which is substantially less than the width of the ornamental shape;

said body having in protruding relationship to said rear surface a projection of such size and shape as to fit linkingly into the strap aperture such that the ornamental shape overlies and hides the strap aperture of an adjacent element when the elements are linked;

wherein the projection extends from the rear surface of the body near an edge thereof farthest from the integral strap such that the link between adjacent interlinked elements is off center relative to the ornamental shape;

whereby the elements may be interlinked with one another in a chain or closed loop of substantially any desired length.

9. The belt defined in claim 8 wherein the strap is non-coplanar with the body and extends integrally from the rear surface of the body.

* * * * *